US006427927B1

(12) United States Patent
Hall

(10) Patent No.: US 6,427,927 B1
(45) Date of Patent: Aug. 6, 2002

(54) ULTRASONIC HEIGHT CONTROL OF FOUNTAIN FEATURES

(76) Inventor: Scott Hall, 5500 NW. 22nd Ave., Ft. Lauderdale, FL (US) 33309

( * ) Notice: Subject to any disclaimer, the term of this patent is extended or adjusted under 35 U.S.C. 154(b) by 0 days.

(21) Appl. No.: 09/733,684

(22) Filed: Dec. 8, 2000

(51) Int. Cl.[7] ..... B05B 17/04; B05B 17/08; E03B 9/20; B67D 5/08

(52) U.S. Cl. ..... 239/17; 239/12; 239/71; 239/16; 239/101

(58) Field of Search ..... 239/17, 16, 101, 239/200, 204, 533.6, 548, 556, 569, 67, 69, 70, 71, 93, 1, 12

(56) References Cited

U.S. PATENT DOCUMENTS 4,213,197 A 7/1980 Magori
4,520,516 A 6/1985 Parsons
4,590,576 A 5/1986 Elpiner
4,817,312 A 4/1989 Fuller et al.
4,948,046 A * 8/1990 Przystawik ..... 239/17
5,044,554 A * 9/1991 Fuller et al. ..... 239/17
5,069,387 A * 12/1991 Alba ..... 239/18
5,134,961 A 8/1992 Giles et al.
5,573,041 A 11/1996 Skell et al.
5,716,129 A * 2/1998 Kunen et al. ..... 362/394
5,839,658 A 11/1998 Sarver
5,853,130 A 12/1998 Ellsworth
6,119,955 A * 9/2000 Starr ..... 239/11

* cited by examiner

*Primary Examiner*—Lesley D. Morris
*Assistant Examiner*—David Hwu
(74) *Attorney, Agent, or Firm*—Kevin P. Crosby, Esq.; Brinkley, Mcnerney, Morgan, Solomon, & Tatum, LLP

(57) ABSTRACT

A fountain which allows interaction by the viewer which alters the fountain's water display. An apparatus and method are disclosed wherein a person viewing the fountain may provide a control indication which causes the fountain display to vary. The preferred embodiment uses an ultrasonic sensor to determine the height of a viewer's hand above a sensor and the water pressure delivered to the fountain is adjusted according to position of the viewer's hand. The invention may use a single or a plurality of sensors to control different groups of jets thereby allowing a large variety of fountain design options.

10 Claims, 2 Drawing Sheets

ULTRASONIC HEIGHT CONTROL OF FOUNTAIN FEATURES

FIELD OF THE INVENTION

The present invention concerns the field of ornamental and decorative water fountains, and more particularly addresses fountains whose operation is interactively controlled by a viewer.

BACKGROUND OF THE INVENTION

Ornamental and decorative water fountains are used in many different environments for a variety of reasons. Ornamental and decorative water fountains typically consist of a water pump which provides pressurized water to one or more output nozzles. The nozzles may be designed to cause the water to exit the nozzle in one of a variety of ways that cause a unique visual effect. Such water fountains are typically configured so that the water output through the nozzles sprays into the air and lands into a collection basin. The collection basin collects most or all of the water sprayed through the nozzles and that water is then re-circulated through the water pump to be again ejected through nozzles for display.

Decorative or ornamental water fountains are typically constructed so as to be aesthetically pleasing. The size of such fountains may range from relatively small to large enough to be considered architectural features of a building or park. Such fountains may also include physical features which only serve an aesthetic function, such as statues, decorative walls, etc. The placement of the nozzles and the form of the outlet stream are usually selected so as to enhance the aesthetic features of the fountain.

The benefits of an ornamental or decorative water fountain may also include the pleasant sound generated by the spray of the water and the water's landing upon the collection basin or other fountain features. The so-called "pink noise" generated by most fountains is not only soothing to the listener, but may be used to mask other sounds in the area of the fountain.

Ornamental and decorative water fountains sometimes have several nozzles which may be pointed in different directions and/or configured to emit a spray in different patterns. Different nozzles may also be supplied with different or varying water pressures. A fountain design may include varying the water pressure over time in order to create a more time varying or dynamic display for the viewer.

Larger water fountains are sometimes used as play areas for children. A large collection basin may be placed at or near ground level so that children may enter the basin and play in the water that is sprayed from the nozzles. The water collection basin of such a fountain may also be integrated into a walkway so as to be more inviting for persons or children to enter the fountain.

Fountains also may incorporate non-water features such as light displays and acoustic displays.

A drawback to prior art fountains is that they tend to be monotonous. Most fountains only emit water through nozzles and provide illumination and/or sound at a fixed rate and pattern. More elaborate fountains may vary the nozzles used or the pressure, or the illumination and/or sound if used, through the nozzles so as to alter the fountain's characteristics. Such varying of features is achieved through a pre-programmed pattern that may or may not fit the viewer's mood or attention span.

SUMMARY OF THE INVENTION

It is an object of the present invention to provide additional functionality to ornamental or decorative water fountains.

It is a further object of the present invention to provide a means of allowing one or more persons to interact with an ornamental or decorative water fountain.

It is yet a further object of the present invention to allow fountain designers to design ornamental or decorative fountains that have a display that may be interactively varied by one or more viewers of the fountain.

The present invention satisfies these and further objectives by providing an apparatus and method of allowing a viewer to control a water fountain. The present invention allows a viewer to place a hand or other object above a sensor that detects and measures the distance that the hand or other object is above that sensor and the height of a fountain spray is adjusted, and/or other features may be adjusted by the provision of additional sensors accordingly.

BRIEF DESCRIPTION OF THE DRAWINGS

These and further features and advantages of the present invention are described in connection with the accompanying drawings, in which.

DESCRIPTION OF THE PREFERRED EMBODIMENT

Figure 1:
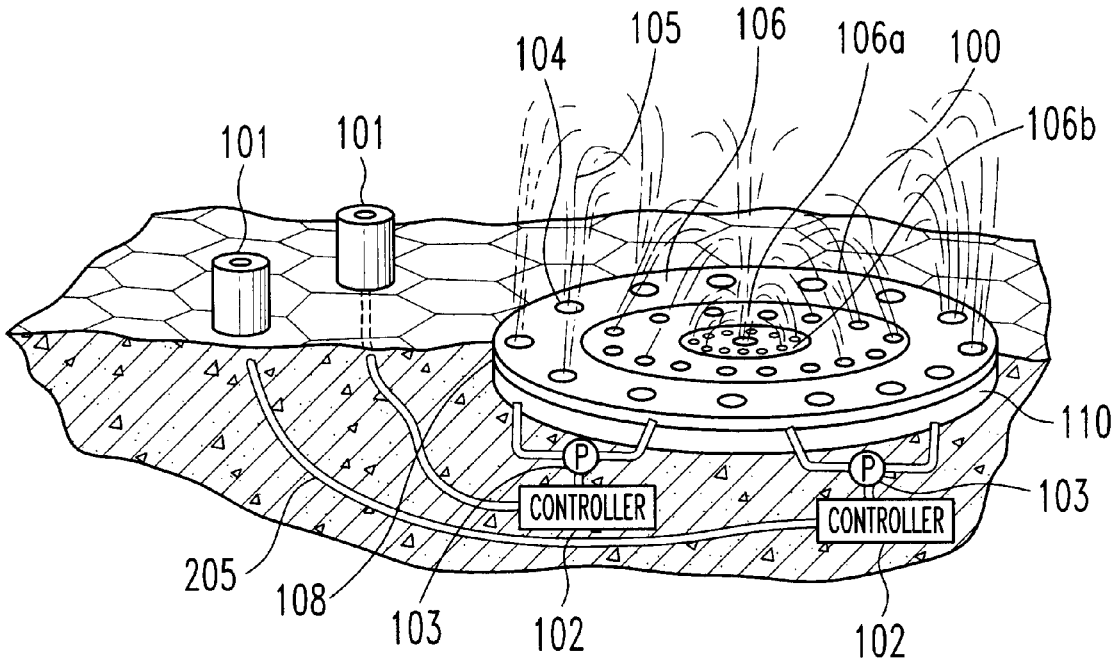
FIG. 1 is a view of an ornamental fountain including buried components utilized by the present invention.

An illustration of the components of the preferred embodiment is shown in FIG. 1. The major components of the present invention are a fountain 100 with a physical water fountain structure 110; one or more nozzles 104 that spray a water jet 105 in a desired fashion; one or more variable speed pumps 103 that pump water under pressure into the nozzles 104; a user interface 101, a controller 102 to control the variable speed pumps 103 in response to a control signal received from the user interface 101; and a water collection basin 108. In its most essential form, which is elaborated below, the present invention provides a water fountain 100 which has water jets 105 whose heights are controlled by a user or users who place a hand some distance above at least one user interface 101 to control fountain features such as water spray height, illumination color and/or intensity, and/or sound output.

The design of the physical water fountain structure 110, placement of the nozzles 104 and the arrangement of the nozzles 104 and water collection basin 108 are well known to practitioners in the relevant arts and is usually driven by aesthetic concerns. The physical water fountain 110 incorporates one or more nozzles 104 that are configured to spray water into the air in a decorative and aesthetically pleasing fashion. The nozzles 104 of the preferred embodiment are supplied with water under pressure that is provided by one or more variable speed pumps 103. The pressure supplied by the variable speed pump 103 may be adjusted by adjusting the speed of the variable speed pumps 103. The speed of the variable speed pumps 103 of the preferred embodiment of the present invention are controlled by one or more controllers 102. In the preferred embodiment, the variable speed pumps 103 utilize variable frequency AC motors, and controllers 102 produce a variable frequency power output to drive those motors at the desired speed. User interface 101 of the preferred embodiment generates a variable voltage indicating the water pressure desired to be produced by the variable speed pump 103. The voltage produced by the user interface 101 is received by controller 102 which varies the speed of the associated variable speed pumps 103 in response thereto. Controller 102 of the preferred embodiment is a digital computer equipped with suitable analog-to-digital converters, digital-to-analog converters, programming, power supplies and other ancillary equipment as needed to supply and control the variable speed pumps 103. A controller 102 and ancillary and appurtenant equipment may be readily designed by practitioners in the relevant arts. The variable speed pumps 103 may be one of a variety of designs which are also known to practitioners in the relevant arts.

The physical fountain structure 110 may incorporate a plurality of nozzles 104 of which each spray water into different directions, into one of several directions or into different patterns. Each of such a plurality of nozzles 104 may also be driven with different water pressure, supplied by separate variable speed pumps 103, so as to cause a variety of water spray effects. This plurality of nozzles 104 may be alternatively organized into nozzle groups 106, wherein each nozzle 104 within a nozzle group 106 is supplied by a common variable speed pump 103. Such a nozzle group 106 will then have the spray of each nozzle 104 within that nozzle group 106 adjusted in unison with all other nozzles 104 within the same nozzle group 106 as the associated variable speed pump 103 is adjusted. Providing a plurality of nozzle groups 106, each supplied with water from an associated variable speed pump 103, allows a wider variety of water spray configurations.

The exemplary water fountain 100 illustrated in FIG. 1 consists of three nozzle groups 106, 106*a* and 106*b* that each comprise a plurality of nozzles 104 that are arranged in a circle. FIG. 1 shows the three nozzle groups 105 as each arranged in circles which are concentric with one other. Each nozzle group 105 in FIG. 1 is supplied with water under variable pressure from a corresponding variable speed pump 103. FIG. 1 illustrates two variable speed pumps for clarity of illustration, with a not-illustrated third variable speed pump suppling the third nozzle group 105*b*.

Figure 2:
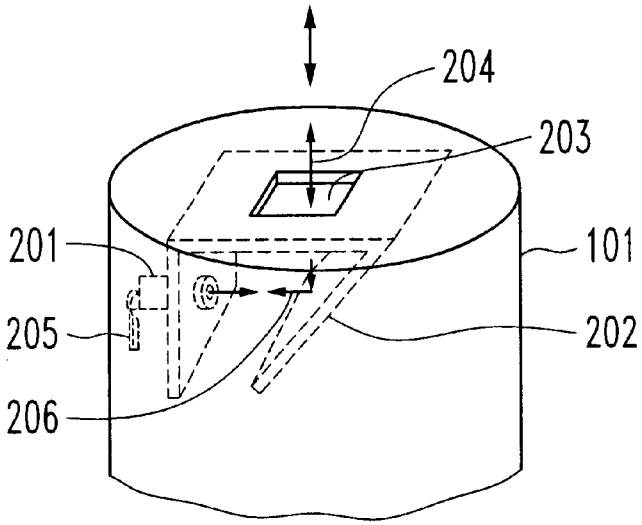
FIG. 2 is a perspective view of a user interface utilized by the present invention.

The detail design of the user interface 101 utilized by the preferred embodiment is illustrated in FIG. 2. The user interface 101 of the preferred embodiment utilizes an ultrasonic range detection system to determine the distance to an object, such as a hand of a user or other objects, that is placed above the user interface. The user interface 101 utilizes an ultrasonic transducer/receiver 201 in order to generate pulsed ultrasonic sound waves that are emitted vertically from the user interface 101 and to receive the reflected ultrasonic sound waves that are reflected from the object above the user interface 101. The ultrasonic transducer/receiver 201 will then transform the measured distance to the object into a proportional output voltage which is output along a cable 205 to the controller 102 in order to control the water pressure delivered to the one or more nozzles associated with interface 101. The design of such an ultrasonic transducer/receiver 201 which measures the distance to an object and which then produces an output voltage that is proportional to the measured distance is readily achieved by practitioners in the relevant arts. Alternative embodiments of the present invention may utilize user interfaces which produce a digital output that represents the distance that the user's hand is above the user interface 101. The cable 205 may be a pair of wires, as in the preferred embodiment, or other communications means such as fiber optic cables or wireless communications.

In order to improve the ruggedness of the user interface against the elements, extended use and even vandalism, the user interface 101 of the preferred embodiment utilizes an indirect ultrasonic beam 204 to measure the distance to the object that is placed above the user interface 101. The ultrasonic sound wave in the preferred embodiment is generated by the ultrasonic transducer/receiver 201 such that the initial ultrasonic wave 206 is emitted in a direction that is to an angle, for example; perpendicular, to the ultimate output ultrasonic wave 204 of the user interface. The initial ultrasonic wave 206 is emitted from the ultrasonic transducer/receiver 201 and is directed toward reflector 202. In the preferred embodiment, reflector 202 is mounted so as to form a forty five degree angle with the initial ultrasonic wave 206 and the output ultrasonic wave 204. It is obvious that other angles between the reflector 202 and initial ultrasonic wave 206 and output ultrasonic wave 204 are possible with corresponding adjustment of the location of ultrasonic transducer 201 relative to reflector 202. After the initial ultrasonic wave 206 impinges upon reflector 202, it become the output ultrasonic wave 204 which is directed toward the user interface ultrasonic port 203. The user interface ultrasonic port 203 may simply be an opening or, as in the preferred embodiment, an opening that is covered with a solid material that is transparent to the ultrasonic wave 204 generated by interface 101. Such a solid material covering of the ultrasonic port 203 will decrease the vulnerability of the user interface to debris and other objects which might enter an uncovered user interface ultrasonic port 203.

It is obvious that a large variety of alternative designs exist for the user interface 101. A user interface 101 may use a direct ultrasonic beam wherein the output of the ultrasonic transducer/receiver 201 is directly output through the interface ultrasonic port 203. Such a design might correspond to mounting the ultrasonic transducer/receiver 201 so as to emit the initial ultrasonic wave 206 vertically and directly through the user interface ultrasonic port. Alternative embodiments of the present invention may also use range detection means based upon radio waves, light waves or other techniques which are known to practitioners in the relevant arts.

The operation of the present invention is illustrated in the three subparts of FIG. 3. For simplicity of illustration, fountain 100 in each of the three parts of FIG. 3 is shown to have only one nozzle 104 and corresponding spray 105. The single user 301 and nozzle 104 shown in FIG. 3 may, of course, be expanded to a plurality of nozzles 104, which may or may be grouped into nozzle groups 106, wherein each nozzle 104 or nozzle group 106 is controlled by a separate user interface 101 and user 301.

Figure 3A:
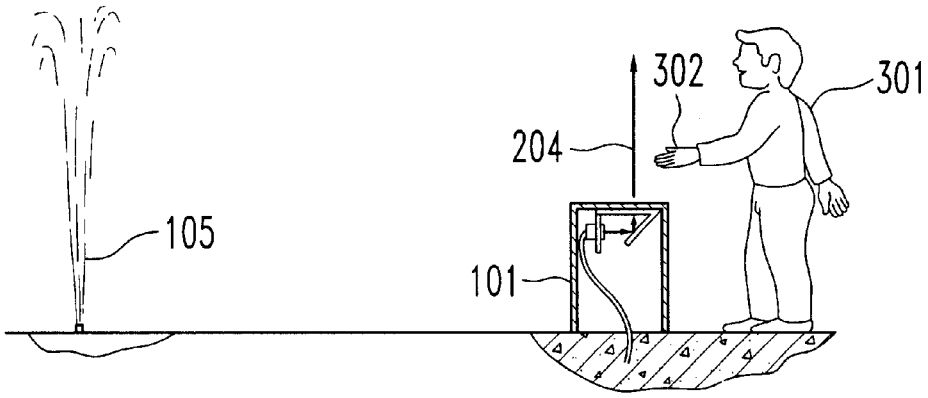
FIG. 3*a* is an illustration showing the present invention operating without interaction by the user.

FIG. 3*a* illustrates a user 301 observing fountain 100. The user 301 is shown standing near a user interface 101 but the user 301 has not yet placed his hand above the user interface 101. FIG. 3*a* illustrates a fountain that is operating without interaction by a user 301. In the illustrated embodiment, the nozzle 104 is emitting a spray 105 with a default height established by the design of the fountain 100. Alternative embodiments may provide that no spray is provided in the absence of interaction by the user 301.

Figure 3B:
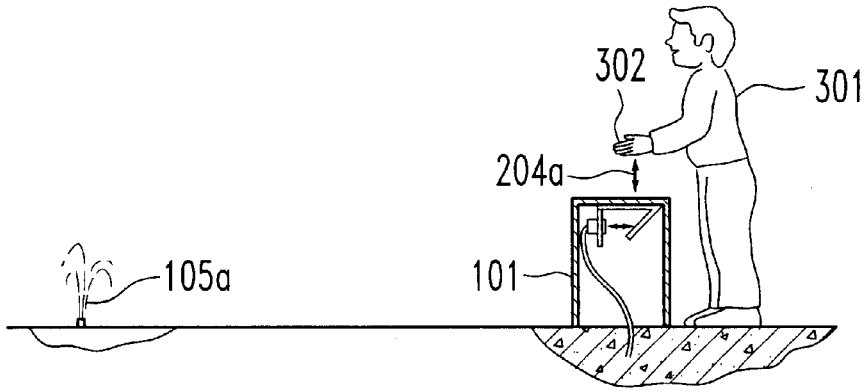
FIG. 3*b* is an illustration showing the present invention with the user controlling the fountain to create a short fountain spray.

FIG. 3*b* illustrates interaction by the user 301 with the fountain. In the preferred embodiment, the user 301 interacts with the fountain by placing his or her hand 302 at a distance above the user interface unit 101. FIG. 3*b* illustrates the user 301 placing his or her hand 302 at a relatively short distance above the user interface 101. The output ultrasonic wave 204*a* in this scenario travels a relatively short distance before being reflected back into the user interface 101. The user interface therefore monitors the indication by the user, i.e. the distance of the user's hand 302 above the user interface 101, and correspondingly produces an output voltage along cable 205 to establish an input into controller 102. Upon receipt of the voltage along cable 205, controller 102 responds by establishing a control output to the corresponding variable speed pump 103 which adjusts the water pressure delivered to nozzle 104 so as to cause a short water spray 105*a* to be emitted from nozzle 104.

Figure 3C:
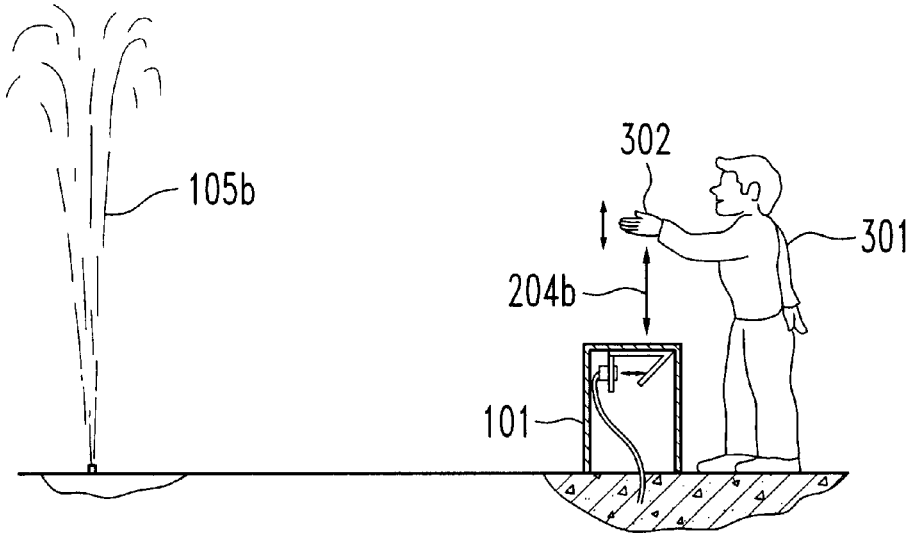
FIG. 3*c* is an illustration showing the present invention with the user controlling the fountain to create a higher fountain spray.

FIG. 3*c* illustrates interaction by the user with the fountain wherein the user has placed his or her hand a greater distance above the user interface. The correspondingly longer propagation of the output ultrasonic wave 204*b* in this scenario causes the user interface 101 to output a correspondingly higher output voltage to communicate the monitored indication by the user, i.e. the higher placed hand. The controller 102 responds to the higher input voltage, and therefore the indication provided by the user, by increasing the speed of the variable speed pump 103 so as to adjust the water pressure delivered to nozzle 104. This higher pressure causes the higher output spray 105*b* to be emitted and viewed by user 301. As long as the user 301 maintains the height of his or her hand at a given level, the height of the fountain spray 105*b* will remain constant. The user 301 may keep his or her hand 302 above the user interface 101 and raise and lower that hand 302 and the height of the spray 105 will correspondingly and continuously raise and lower in response thereto.

The ornamental fountain may be a conventional fountain or may alternatively be a fountain which allows children or persons to enter into the water spray. The latter type of fountain may utilize nozzles 104 that are incorporated into walkways in order to increase the accessability into the fountain by children or other persons.

Embodiments of the present invention may utilize multiple user interfaces 101 to control multiple nozzles 104 or nozzle groups 105. Fountains may be designed which incorporate more involved control logic which allows combinations of user indications observed by the user interfaces 101 so that the emission of each nozzle or nozzle group is a combination of a plurality of user indications.

In addition or in the alternative, the invention also contemplates the utilization of interactive controls for controlling light and/or sound features of a decorative fountain. The control arrangement set forth above can be applied to vary the output of an illumination system within the fountain and/or sound effects in a manor which will occur to those of skills in the art.

Alternatively, the ultrasonic sensor and pedestal arrangements can be replaced by any other interactive control arrangement such as knobs, dials, switches, voice command controls and the like without departing from the scope hereof. All that is required is an interactive control arrangement to permit users near by a decorative water fountain to control the various features, e.g. water jets, illumination, sound, etc., from a safe distance in proximity to the fountain.

Obviously, numerous modifications and variations of the present invention are possible in light of the above teachings. It is therefore to be understood that, within the scope of the appended claims, the invention may be practiced otherwise than as specifically described herein.

I claim:

1. A method of controlling a water fountain display, comprising the steps of:

monitoring an indication made by one or more users of said fountain display;

in response to said step of monitoring, adjusting the pressure of water delivered to one or more nozzles of said fountain;

wherein said step of monitoring comprises monitoring a distance from at least one monitor of a hand of each of said one or more users, and wherein said hand of each of said one or more users is placed in registry with the at least one monitor.

2. A method according to claim 1, wherein each of said one or more users causes adjustment of a specific nozzle.

3. A method according to claim 1, wherein said one or more nozzles are arranged into a plurality of nozzle groups and wherein each nozzle group within said plurality of nozzle groups is controlled by a specific indication monitored from said step of monitoring an indication, wherein said specific indication is made by one of said one or more users.

4. An interactive display fountain, comprising:

means for monitoring an indication made by one or more users of said fountain display; and means for adjusting the pressure of water delivered to one or more nozzles of said fountain, wherein said means for adjusting operates in response to an output provided by said means for monitoring;

wherein said means for monitoring comprises means for monitoring a distance from at least one monitor of a hand of each of said one or more users, and wherein said hand of each of said one or more users is placed in registry with the at least one monitor.

5. An interactive display fountain according to claim 4, wherein each of said one or more users causes adjustment of a specific nozzle.

6. An interactive display fountain according to claim 4, wherein said one or more nozzles are arranged into a plurality of nozzle groups and wherein each nozzle group within said plurality of nozzle groups is controlled by a specific output produced by said means for monitoring, wherein said specific output corresponds to a specific indication made by one of said one or more users.

7. An interactive display fountain, comprising:

a user interface for monitoring an indication by one or more users of said fountain display, wherein said user interface provides an output corresponding to said indication;

a variable speed pump for adjusting the pressure of water delivered to one or more nozzles of said fountain; and a controller for controlling water pressure produced by said variable speed pump, wherein said controller operates in response to said output provided by said user interface;

wherein said indication is an object placed a distance away from said user interface.

8. An interactive display fountain according to claim 7, wherein said user interface utilizes ultrasonic distance measuring techniques.

9. An interactive display fountain according to claim 7, further including a variable output energy source for interactively adjusting the intensity of illumination sources associated with fountain.

10. An interactive display fountain according to claim 7, further including a variable output audio signal controller for interactively varying the sound intensity of a sound system associated with the fountain.

* * * * *